United States Patent [19]

Belley

[11] Patent Number: 4,759,422

[45] Date of Patent: Jul. 26, 1988

[54] SILENCER FOR A COOLING FAN OF A VACUUM CLEANING SYSTEM

[75] Inventor: Richard A. Belley, Montreal, Canada

[73] Assignee: Duo-Vac Inc., Quebec, Canada

[21] Appl. No.: 45,389

[22] Filed: May 4, 1987

[51] Int. Cl.[4] ..... F01N 1/24

[52] U.S. Cl. ..... 181/225; 181/256

[58] Field of Search ..... 181/212, 225, 229, 231, 181/238, 252, 202, 204, 256; 123/198 E

[56] References Cited

U.S. PATENT DOCUMENTS

| | | | |
|---|---|---|---|
| 2,323,955 | 7/1943 | Wilson | 181/229 |
| 3,399,515 | 9/1968 | Hehl | 123/198 F X |
| 3,537,544 | 11/1970 | King | 181/225 |
| 3,614,859 | 10/1971 | Clark | 181/229 X |
| 4,483,413 | 11/1984 | Ohashi | 181/229 X |

*Primary Examiner*—B. R. Fuller

*Attorney, Agent, or Firm*—Roland L. Morneau

[57] ABSTRACT

A silencer to be mounted on the air intake of a cooling fan of an electric motor in a vacuum cleaning system. The silencer comprises a cylindrical housing closed at one end and opened at the other end. The housing is provided with perforations around its periphery adjacent the closed end. A sleeve made of sound absorbing material lines the inside of the housing without obstructing the perforations.

2 Claims, 2 Drawing Sheets

SILENCER FOR A COOLING FAN OF A VACUUM CLEANING SYSTEM

BACKGROUND OF THE INVENTION

The prior art shows that multiple attempts have been made to muffle the sound of vacuum cleaning apparatus from blower-motor units by considering the exhaust noise caused by the working air of the vacuum cleaner such as described in Canadian Pat. No. 1,122,761

The same principle applies to the vacuum cleaner described in Canadian Pat. No. 1,142,716 which uses a sound insulating device at the outlet of the working air i.e. at the outlet of the suction unit.

In Canadian Pat. No. 595,301, Wall has attempted to reduce the noise produced by a dynamo-electric machine by mounting a sound absorbent device adjacent the fan. However, the sound absorbent device has a totally different concept and operates on principles distinct from the present invention.

BRIEF DESCRIPTION OF THE INVENTION

The present invention is intented to be used with central vacuum cleaners using known mufflers at the exhaust of the working air. Such a vacuum cleaner uses an electric motor to actuate a centrifugal compressor which is used to create a vacuum at its air intake opening. The electric motor also actuates a fan which serves to cool the motor. The electric motor and the fan, which rotates at high speed, produce high frequency noise which is muffled by the silencer according to the present invention.

The silencer is mounted at the air intake of the fan. It comprises a tubular housing sealed at one end to the air intake of the fan and a tubular sound absorbing lining inside said housing, a cover for closing the other end of said housing. The housing is provided with perforations adjacent said cover, whereby the incoming air passes through said perforations and is reflected partly on the lining, the said lining causing the sound waves from the fan to be partly absorbed.

DETAILED DESCRIPTION

Figure 4:
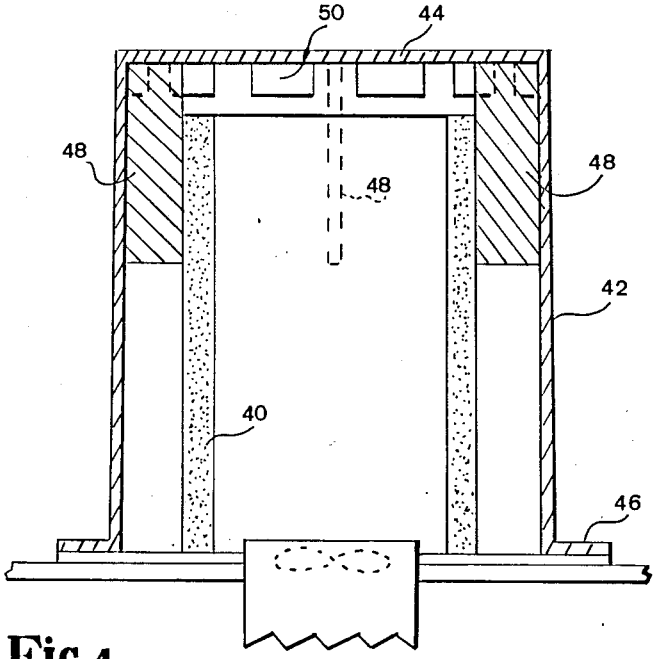
FIG. 4: is a sectional view of another embodiment of the silencer.

The vacuum cleaner 10 is of the type which is centrally located in a house or a building. It consists of an electric motor 12 which actuates the blades of a centrifugal compressor 14. The latter acts as a suction device to perform as a vacuum cleaner. The air, identified by arrows A, is pumped by the blades of the compressor 14 at the intake of the vacuum cleaner and is projected at the outlet 16 and through a conventional known muffler 18. Because the electric motor 12 rotates at very high speed, a fan 20 also actuated by the motor 12, is mounted above the latter to cool the motor. Arrows B identify the air intake of the fan and arrows C identify the exit of the air generated by the fan 20. What has been described above characterizes common features of central vacuum cleaners.

Three sources of noise can be identified. The most important one is generated by the air projected out of the compressor. Known mufflers have been used to reduce this source of noise. The second source of noise comes from the blades of the compressor but is considered of a negligeable intensity. The third source comes from the fan 20 for cooling the motor 12 and from the friction of the carbon brushes against the commutator.

The present invention is directed to the silencing of this third source which covers a range of high frequencies. Although, it is common pratice to locate a muffler in the air circuit adjacent the outlet, the present invention is directed to a silencer 22 adjacent the air intake of the motor 12. It seals the air intake and accepts air exclusively through perforations 24.

Figure 2:
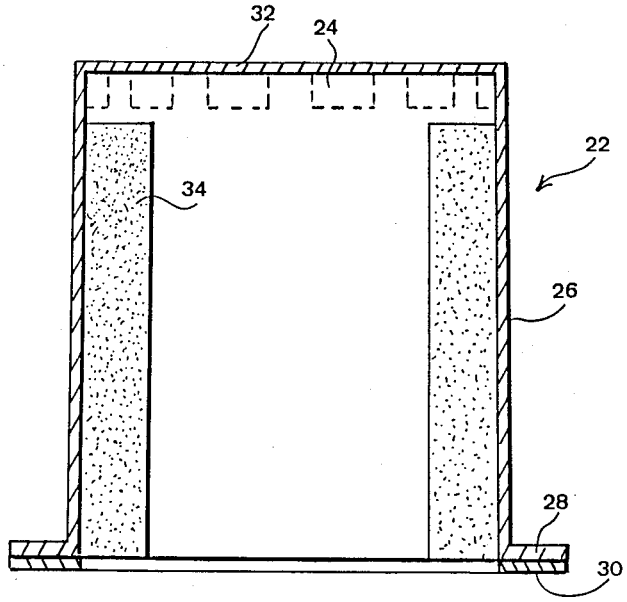
FIG. 2: is a cross-sectional view of one embodiment of the silencer.
Figure 3:
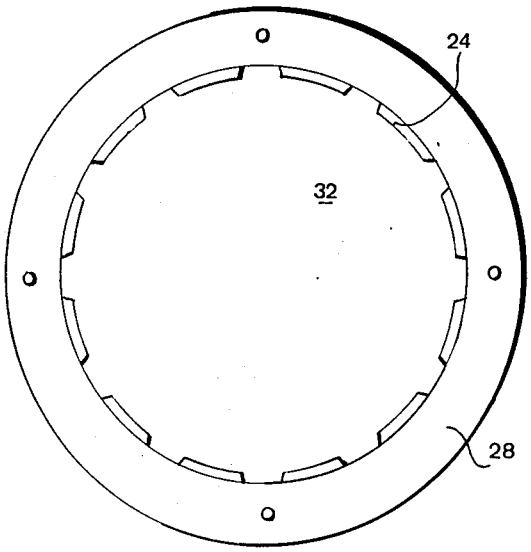
FIG. 3: is a top view of the silencer shown in FIG. 2.

As shown in FIG. 2, the silencer 22 consists of a tubular housing 26 opened at one end and provided at that end with a circular flange 28 adapted to surround the air intake of the fan 20. A ring 30 made of closed pore foam such as neoprene is inserted under the flange 28 to create an air seal. The housing 26 is preferably made of rigid plastic, is substantially cylindrical and has a height substantially similar to it diameter. The housing has a substantially flat cover 32 and is provided with rectangular perforations around its periphery adjacent the cover. The peripheral wall of the housing 26 is covered with a lining 34 made of foam or fibrous material having opened pores such as polyurethane. The lining 34 extends from the level of the flange 28 to a level slightly below the bottom of the perforations 24 which must remain unobstructed. For optimum results, the thickness of the lining may vary from 0.4 to 1 inch depending on the range of frequencies to be absorbed and the average angle of incidence of the sound waves on the lining.

For an average frequency f of 2500 Hz $$\lambda = c/f = 1100/2500 = 0.44 \text{ ft.}$$

Wherein $\lambda$ = the wavelength c = the speed of sound in feet per second

The thickness of the lining is chosen within the range of:

$$t = \lambda/10 \text{ to } \lambda/4$$

The height of the housing appears to vary according to empirical rules which indicate that when it is too short, the sound buffering effect is not sufficient and an increase in length does not add substantially to the buffering effect.

In a specific arrangement, the following dimensions of the housing provides optimum results

| | |
|---|---|
| Diameter | 4.5 in. |
| Height | 5.0 in. |
| Size of perforations | ⅜ in × .7 in. |
| Number of perforations | 12 |

The surface of all the perforations should not be smaller than the area of the air intake of the motor. It should be obvious that perforations can be of various shapes other than rectangular.

Sound waves must exit through the perforations 24. However, before they reach the perforations, the majority will be reflected many times on the housing and each time a percentage will be absorbed by the lining.

Another embodiment of the silencer is illustrated in FIG. 4 wherein the lining 40 is spaced from the housing 42. It is suspended from the cover 44 and extends down to the level of the flange 46. The spacing between the housing 42 and the lining is maintained by four radial partitions 48. Perforations 50 located adjacent the closed end of the housing 42 are not obstructed by the lining 40. With this arrangement, the sound waves leaving the fan at an angle relative to the axis of the housing are partly absorbed when passing through the lining 40 are subsequently reflected by the housing 42 and are absorbed once more when passing through the lining a second time. Such reflections may occur many times depending on the angle of the sound waves. The arrangement of the lining as shown in FIG. 4 allows the thickness of the sound absorbing lining to be reduced.

Although the inner surface of the cover 32 or 44 may be lined with sound absorbing material, the bare surface produces a reflection of the sound waves towards the lateral lining.

Figure 1:
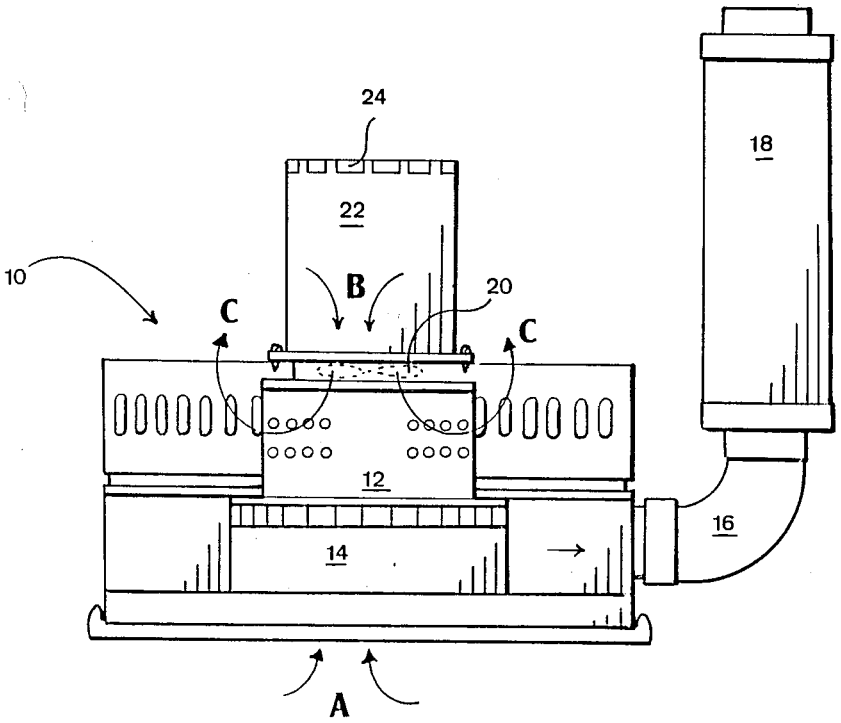
FIG. 1: is a schematic view of the silencer according to the invention mounted on a vacuum cleaning system.

Measurements of the reduction of the sound level were made. Two sonometers were located at two meters from a vacuum cleaner and at a height of 1.3 meters. The vacuum cleaner was positioned at a height of one meter from the ground. The two sonometers were disposed in planes forming 90 degrees with the vacuum cleaner. The test included many measurements for different groups of frequencies while the vacuum cleaner was sucking dust or not. For a vacuum cleaner producing 87 dBA without any silencer, the addition of a standard muffler at the outlet of the working air such as 18 in FIG. 1 was reducing the sound level to 80 dBA. The further addition of the silencer 22 according to the invention resulted in a reduction of the sound level to 75 dBA.

I claim:

1. A silencer for completely covering the air intake of a cooling fan mounted on an electric motor in a central vacuum cleaning system, the said silencer comprising;

a cylindrical housing exclusively opened at both ends, means for sealing one end of said housing to the air intake of said fan, the height of said housing being substantially equal to its diameter, a cylindrical lining covering an internal surface of said housing, said lining being made of sound absorbing opened cell foam plastic material having a thickness of about 0.4 to 1 inch, the internal surface of said lining being directly exposed to incoming air passing therethrough, a cover for closing the other end of said housing, the housing being provided with perforations in a periphery portion adjacent said cover, whereby the incoming air passes through the perforations at said other end of said housing and exit at said one end of said housing connected to the air intake of said fan, and sound waves emitted by said fan are, many times, reflected on said lining for causing said sound waves to be, each time partly absorbed by said lining before said waves reach said one end of said housing.

2. A silencer as recited in claim 1, wherein said cylindrical housing has a height of about 5 inches and a diameter of about $4\frac{1}{2}$ inches.

* * * * *